US006145854A

United States Patent [19]

Cheng

[11] Patent Number: 6,145,854

[45] Date of Patent: Nov. 14, 2000

[54] IN-LINE ROLLER SKATE

[76] Inventor: Tsan-Hsiung Cheng, No. 1051, Lung Tien, Lung-Pen Tsun, Kuan-Tien Hsiang, Tainan Hsien, Taiwan

[21] Appl. No.: 09/286,934

[22] Filed: Apr. 7, 1999

[51] Int. Cl.[7] ..... A63C 17/02

[52] U.S. Cl. ..... 280/11.22; 280/11.28; 280/11.3

[58] Field of Search ..... 280/11.19, 11.2, 280/11.22, 11.23, 11.25, 11.27, 11.28, 11.3, 809, 841, 11.12

[56] References Cited

U.S. PATENT DOCUMENTS

| | | | |
|---|---|---|---|
| 4,596,396 | 6/1986 | Merbler | 280/11.28 |
| 5,232,231 | 8/1993 | Carlsmith | 280/11.2 |
| 5,340,132 | 8/1994 | Malewicz | 280/11.22 |
| 5,342,071 | 8/1994 | Soo | 280/11.22 |
| 5,452,907 | 9/1995 | Meibock et al. | 280/11.22 |
| 5,873,584 | 2/1999 | Wrike | 280/11.22 |
| 5,890,723 | 4/1999 | Benoit | 280/11.22 |
| 5,904,360 | 5/1999 | Oliemans et al. | 280/11.28 |
| 5,918,889 | 7/1999 | Tai | 280/11.22 |
| 5,961,129 | 10/1999 | Post et al. | 280/7.13 |

*Primary Examiner*—Brian L. Johnson
*Assistant Examiner*—Bridget Avery
*Attorney, Agent, or Firm*—Dougherty & Troxell

[57] ABSTRACT

An in-line roller skate, which includes a boot, a front wheel frame and a rear wheel frame respectively pivoted to the sole of the boot by rivets and arranged in a line to hold a respective pair of longitudinally aligned wheels, a brake block selectively fastened to the front wheel frame or rear wheel frame, and two elastic blocks respectively mounted in between a respective bottom trough at the sole of the boot and a respective top trough at one of the wheel frames to absorb shocks and to compensate sideways component of force upon turning of the in-line roller skate.

4 Claims, 9 Drawing Sheets

IN-LINE ROLLER SKATE

BACKGROUND OF THE INVENTION

The present invention relates to an in-line roller skate, and more particularly to such an in-line roller skate which comprises a foot, two wheel frames respectively pivoted to the sole of the boot by rivets to hold a plurality of wheels in a line, and two elastic blocks coupled between the boot and the wheel frames to absorb shocks and buffer tilting force.

In conventional roller skates, wheels are arranged in pair. When skating, the wheels are moved along two parallel skating lines (see FIG. 2). Because of much contact area between the wheels and the ground, much resistance is produced when skating on a conventional roller skate. Further, the wheels of a conventional roller skate may be struck with stones or foreign objects during skating. Therefore, it is difficult to make a smooth skating on a conventional roller skate. Recently, in-line roller skates have become more and more popular for the advantages of high performance. An in-line roller skate, as shown in FIG. 1, is comprised of a plurality of wheels arranged in a line. The wheels for in-line roller skate commonly have a smoothly curved periphery (see FIG. 3). This design diminishes the contact area between the wheels and the ground. Because the wheels of the in-line roller skate are arranged on a wheel frame in a line, the in-line roller skate can be moved at a high speed. However, this design cannot make the skater take a turn except the skater lifts the toe or heel. When lifting the toe or heel, users must pay attention in order to keep the body in balance. Furthermore, because the wheel frame of an in-line roller skate is a solid frame, a single wheel receives much torque when the skater deflects the roller skate. So the wheel of an in-line roller skate wears quickly with use. Therefore, this conventional in-line roller skate is not durable in use. FIG. 4 shows another structure of roller skate according to the prior art. This structure of roller skate comprises a sole plate fixedly mounted on the sole of the boot thereof to hold a rear wheel and a heel stop (brake block). A bolt is raised from the sole plate near its front side to hold a bearing and a wheel spring holder. The wheel spring holder has two side lugs. A spherical wheel is coupled between the side lugs on the wheel spring holder. This structure of roller skate allows the skater to freely switch the skating direction. However, it is difficult to keep the roller skate in balance when making a turn or snake skating. Therefore, this structure of roller skate is not suitable for beginners.

SUMMARY OF THE INVENTION

The present invention provides an in-line roller skate which eliminates the aforesaid drawbacks. According to one aspect of the present invention, the in-line roller skate comprises a boot, a front wheel frame and a rear wheel frame mounted on the sole of the boot and arranged in a line to hold a respective pair of longitudinally aligned wheels, and two elastic blocks mounted in between a respective bottom trough at the sole of the boot and a respective top trough at one of the wheel frames to absorb shocks and to compensate sideways component of force upon turning of the in-line roller skate. According to another aspect of the present invention, the front wheel frame and the rear wheel frame are respectively pivoted to the sole of the boot thereof by rivets, therefore they can be respectively turned leftwards or rightwards about the respective rivet. According to still another aspect of the present invention, the front wheel frame has a bottom screw hole near its front end, the rear wheel frame has a bottom screw hole near its rear end, and a brake block can be selectively fastened to the bottom screw hole at the front wheel frame or the rear wheel frame as desired.

DETAILED DESCRIPTION OF THE PREFERRED EMBODIMENT

Figure 1:
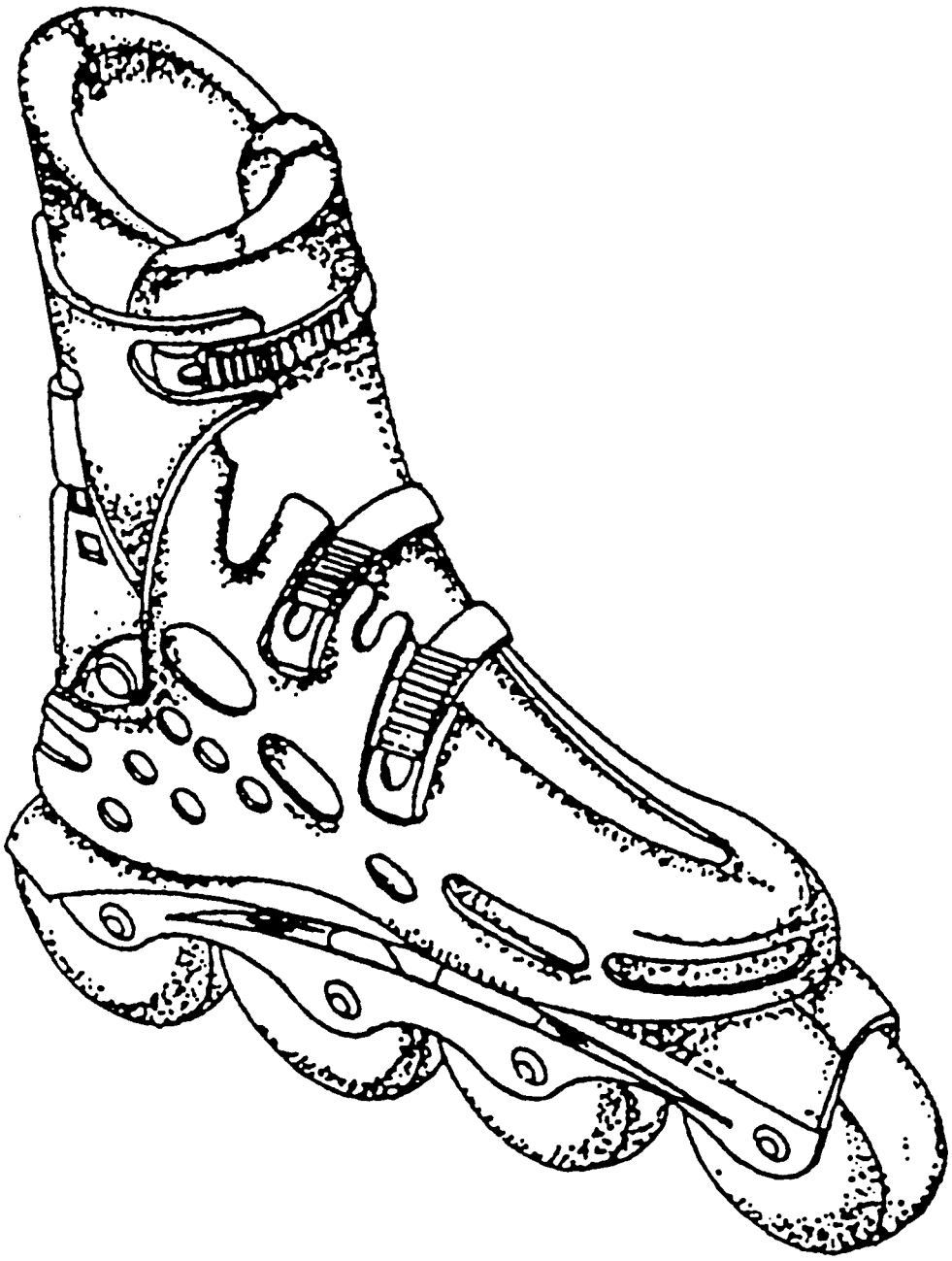
FIG.1 PRIOR ART
FIG. 1 is a perspective view of an in-line roller skate according to the prior art.
Figure 2:
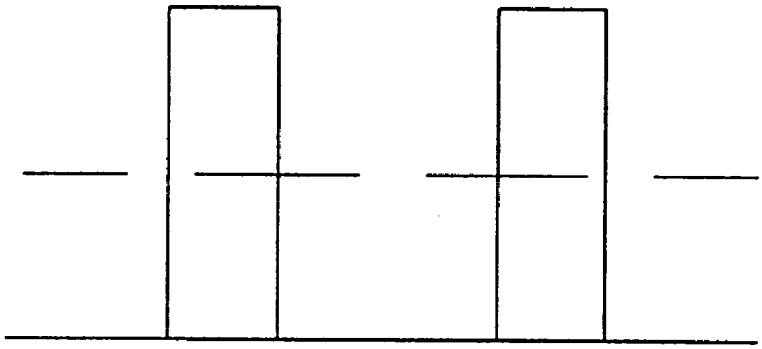
FIG.2 PRIOR ART
FIG. 2 is a schematic drawing showing the contact between the wheels of a conventional roller skate and the ground according to the prior art.
Figure 3:
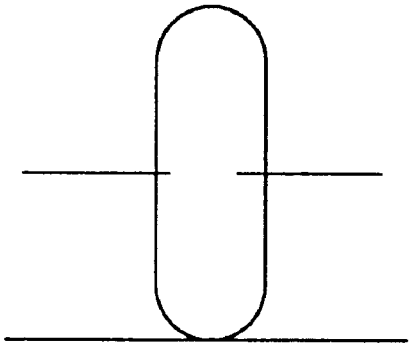
FIG.3 PRIOR ART
FIG. 3 is a schematic drawing showing the contact between the wheels of a conventional in-line roller skate and the ground according to the prior art.
Figure 4:
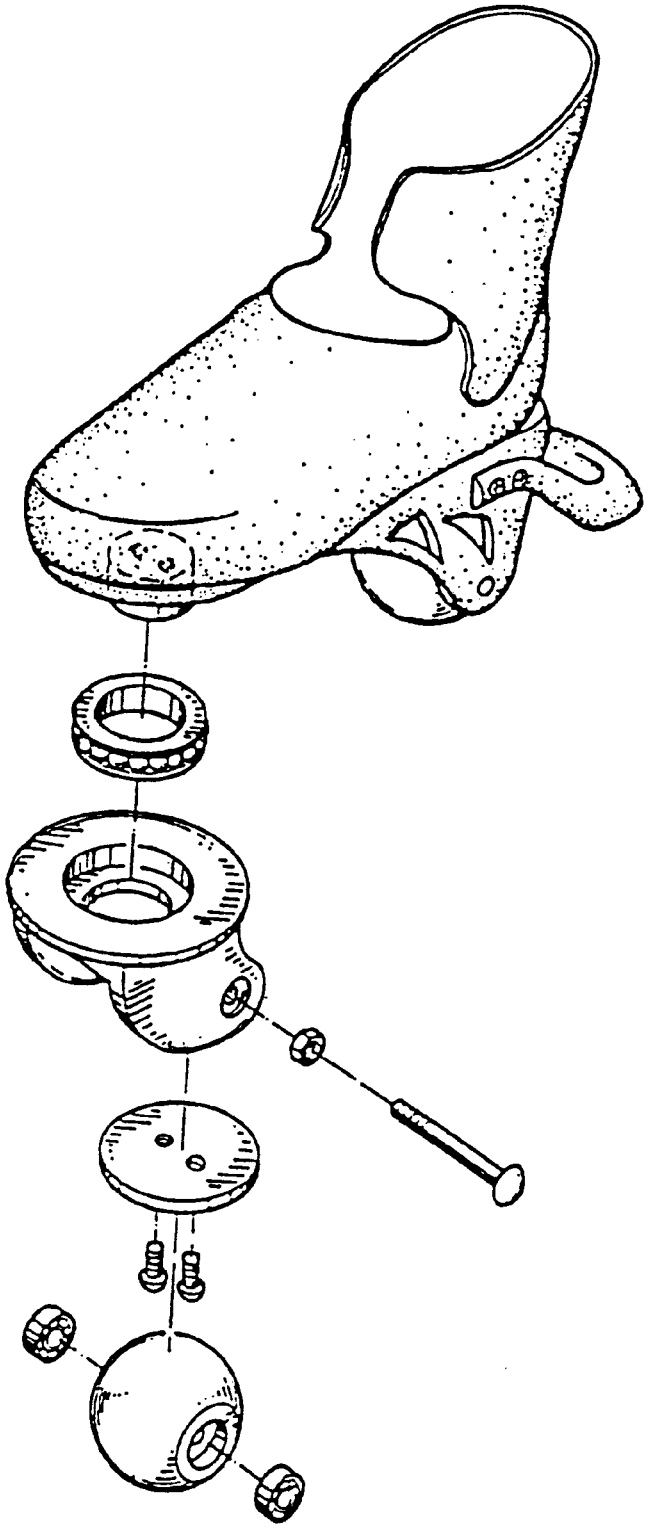
FIG. 4 PRIOR ART
FIG. 4 is an exploded view of another structure of prior art roller skate.
Figure 5:
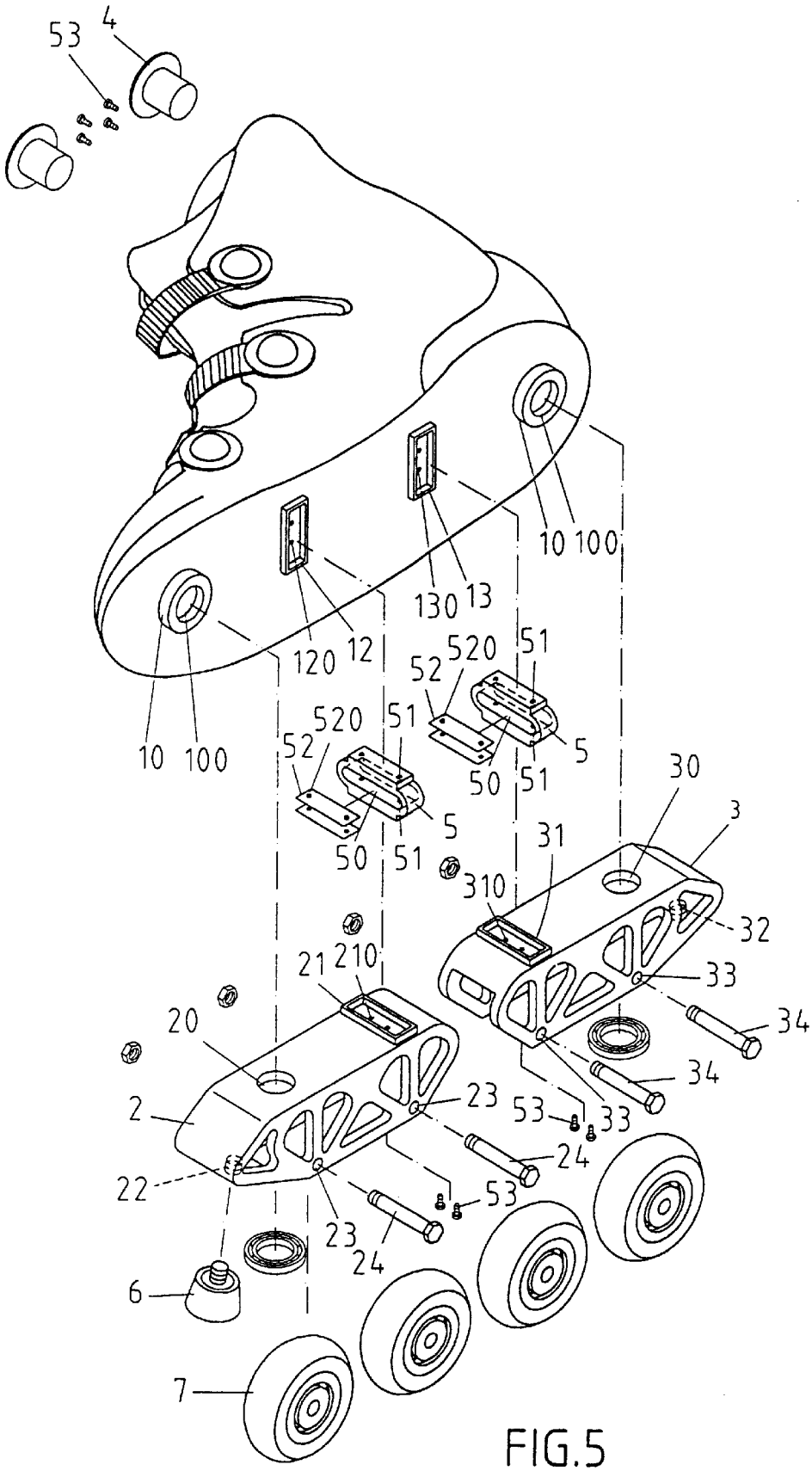
FIG. 5 is an exploded view of an in-line roller skate according to the present invention.
Figure 6:
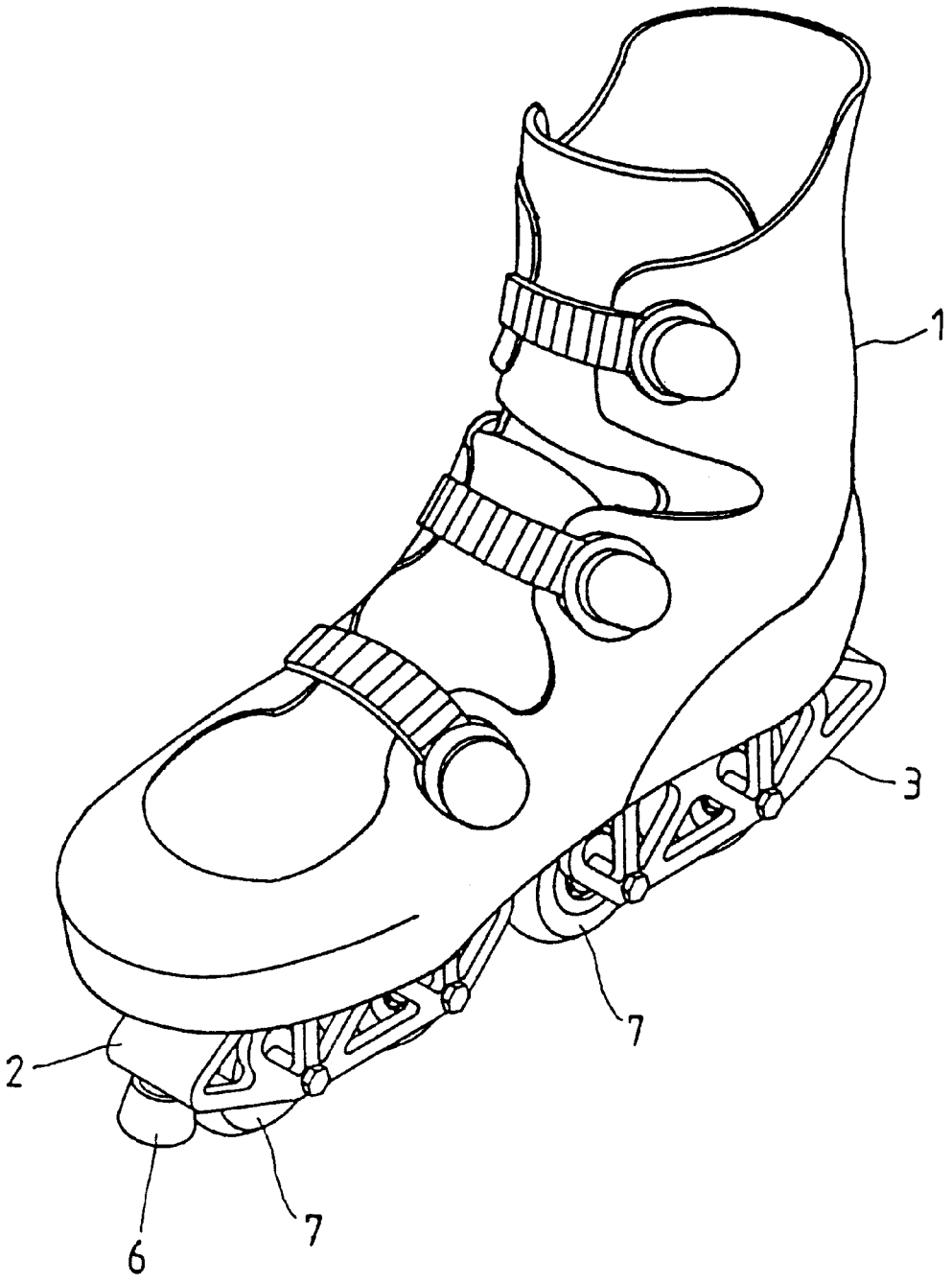
FIG. 6 is a perspective view of an in-line roller skate according to the present invention.

Referring to FIG. 5, an in-line roller skate in accordance with the present invention is generally comprised of a boot 1, a front wheel frame 2, a rear wheel frame 3, two rivets 4, two elastic blocks 5, a brake block 6, and four wheels 7.

The boot 1 is injection-molded from plastics, comprising two studs 10 raised from the sole thereof near two opposite ends, the studs 10 each defining a through hole 100 through the sole, a first bottom trough 12 and a second bottom trough 13 transversely disposed at the sole and spaced between the studs 10, and a plurality of mounting holes 120 and 130 respectively provided in the bottom troughs 12 and 13 through the sole. The wheel frames 2;3 are respectively fixedly fastened to the sole of the boot 1 by the rivets 4, and longitudinally arranged in a line. Each wheel frame 2 or 3 comprises a through hole 20 or 30 respectively fastened to the through holes 100 in the studs 10 at the boot 1 by the rivets 4, a top trough 21 or 31 disposed at the top corresponding to one recess 12 or 13 at the sole of the boot 1, a plurality of mounting holes 210 or 310 in the top trough 21 or 31 corresponding to the mounting holes 120 or 130 in the bottom trough 12 or 13 at the sole 1, two transverse axle holes 23 or 33, and two bolts 24 or 34 respectively mounted in the transverse axle holes 23 or 34 to hold one pair of the wheels 7 in a line. One wheel frame 2 has a downwardly extended screw hole 22 near its front side. The other wheel frame 3 has a downwardly extended screw hole 32 near its rear side. The rivets 4 are respectively fastened to the through holes 100 in the studs 10 at the boot 1 and the through holes 20;30 at the wheel frames 2;3 to secure the wheel frames 2;3 to the boot 1, enabling the wheel frames 2;3 to be turned about the rivets 4 leftwards or rightwards. The elastic blocks 5 are molded from rubber, and respectively mounted in between the bottom troughs 12 and 13 at the sole of the boot 1 and the top troughs 21 and 31 at the wheel frames 2 and 3 Each elastic block 5 comprises a side open chamber 50, and a plurality of mounting holes 51 through top and bottom side walls thereof in communication with the side open chamber 50. Further, two reinforcing rigid plates 52 are mounted in the side open chamber 50 in each elastic block 5 at top and bottom sides, each having a plurality of screw holes 520 respectively fastened to the mounting holes 51 at the corresponding elastic block 5 by respective fastening elements 53. The fastening elements 53 can be screws or rivets. The brake block 6 can be fastened to the screw hole 22 at the front wheel frame 2 or the screw hole 32 at the rear wheel frame 3. The wheels 7 are respectively mounted in the wheel frames 2;3, and turned about the bolts 24;34.

The assembly process of the in-line roller skate is outlined hereinafter with reference to FIG. from 5 through 7. The elastic blocks 5 are respectively mounted in between the bottom troughs 12 and 13 at the sole of the boot 1 and the top troughs 21 and 31 at the wheel frames 2 and 3, then fastening elements 53 are respectively inserted through the mounting holes 120 and 130 at the boot 1 and mounting holes 210 and 310 at the wheel frames 2 and 3 from top and bottom sides into the mounting holes 51 at the elastic blocks 5, and then threaded into the screw holes 520 at the rigid plates 52, and then the rivets 4 are respectively mounted in the through holes 100 at the boot 1 and the through holes 20 and 30 at the wheel frames 2 and 3 to secure the boot 1 and the wheel frames 2 and 3 together, and then the wheels 7 are respectively fastened to the front wheel frame 2 and the rear wheel frame 3 by the bolts 24;34, and then the brake block 6 is fastened to the screw hole 22 at the front wheel frame 2 or the screw hole 32 at the rear wheel frame 3.

Figure 7:
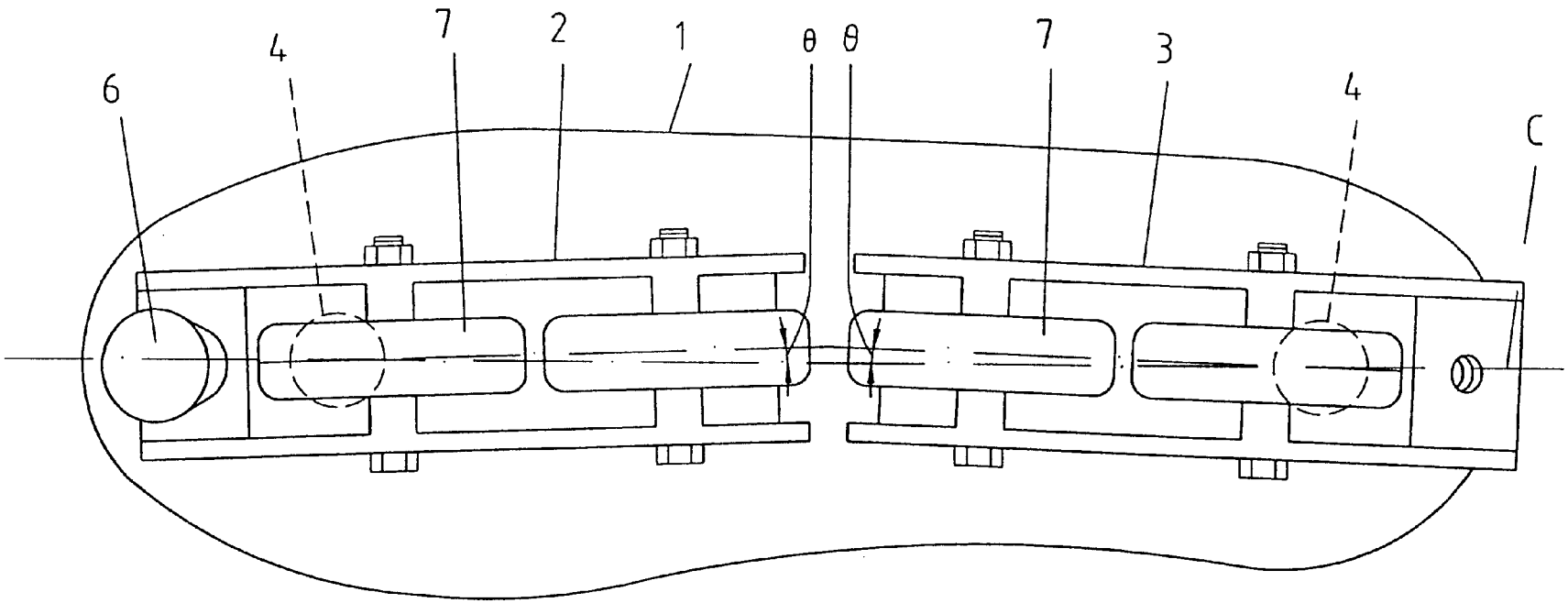
FIG. 7 is a bottom view of the in-line roller skate according to the present invention.
Figure 9:
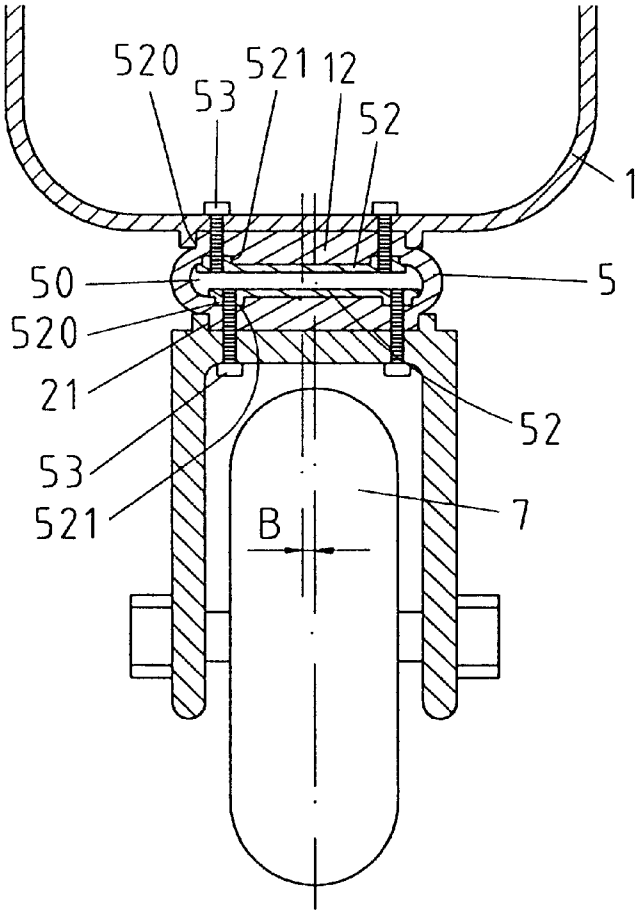
FIG. 9 is similar to FIG. 8 but showing the elastic block tilted.
Figure 8:
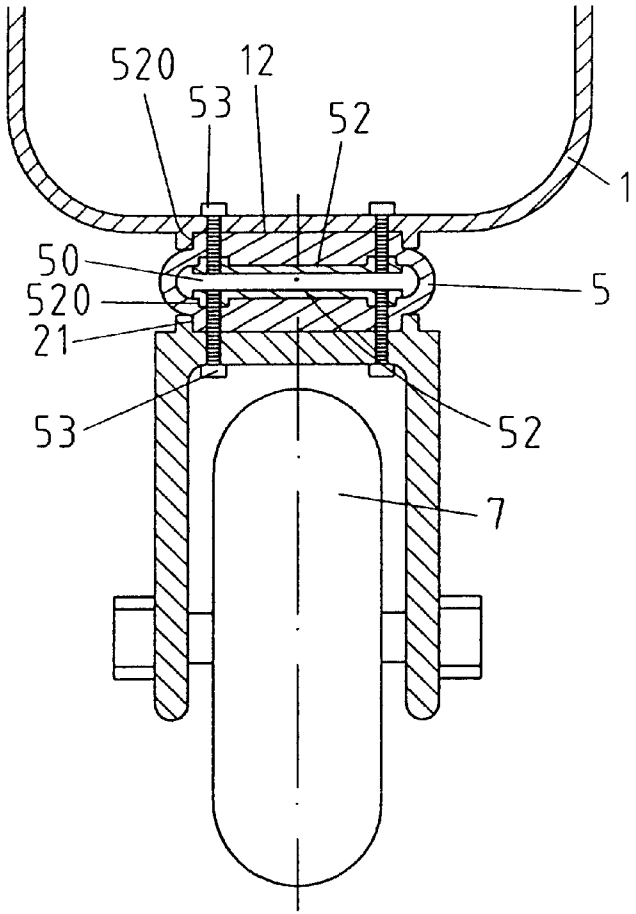
FIG. 8 is a sectional view of a part of the present invention, showing the elastic block connected between the boot and the wheel frame.
Figure 10:
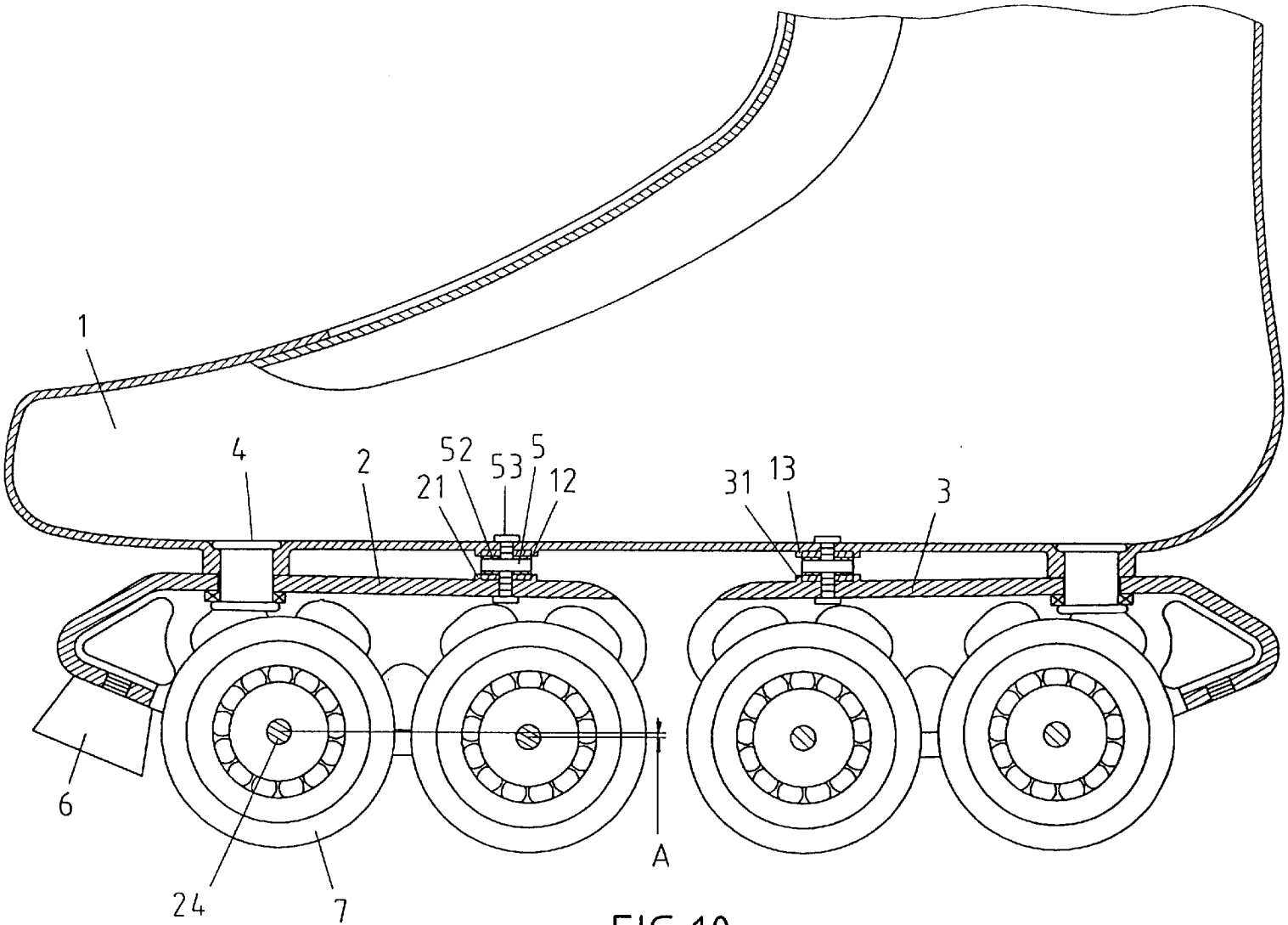
FIG. 10 is a side view in section of the present invention.
Figure 12:
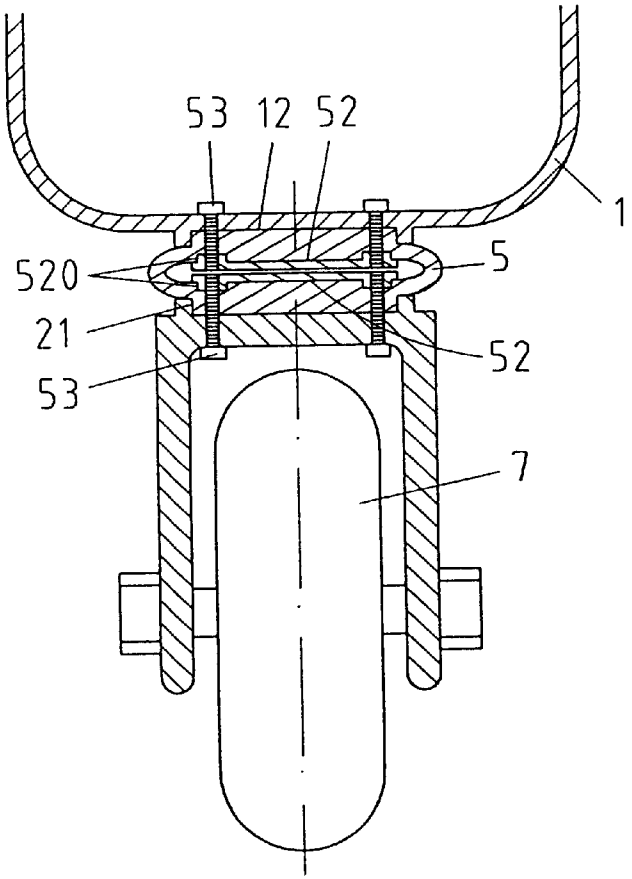
FIG. 12 is similar to FIG. 8 but showing the elastic block vertically compressed.
Figure 11:
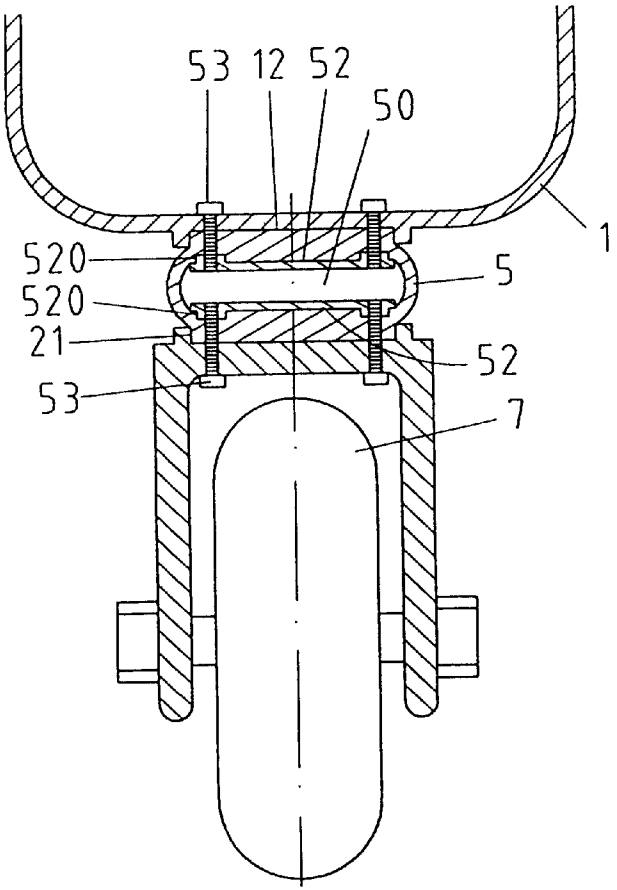
FIG. 11 is similar to FIG. 8 but showing the elastic block pulled downwards.

Referring to FIGS. from 8 through 12 and FIG. 7 again, when the user skates straightway forwards, the four wheels 7 are longitudinally aligned, and the elastic blocks 5 are compressed at an amount "A" (see FIG. 10) to absorb shocks. When making a turn or changing the skating direction, the roller skate is slightly tilted leftwards or rightwards subject to the desired direction, thereby causing the wheels 7 to deviate from the longitudinal central line C at an angle θ (see FIG. 7), and therefore the wheels 7 are moved forwards along a curve line. When the wheels 7 are forced to deviate from the longitudinal central line C at a distance B (see FIG. 9), the elastic blocks 5 buffer the tilting force, therefore the skater can smoothly maintain the body in balance (such as riding a bicycle in hand free, but won't get fall). When the skater performs a fancy skating, the front wheel frame 2 and the rear wheel frame 3 are suffering a downward pulling force. And then the elastic blocks 5 and the rivets 4 can bear the downward pulling force and fix the front wheel frame 2 and the rear wheel frame 3 accordingly. When the tilting force is released, the elastic blocks 5 immediately return to their former shape (see FIG. 8), and the wheels 7 are returned to the longitudinally aligned position. If the skater is going to fall when skating, the wheels 7 are a utomatically forced to deviate from the longitudinal central line C at an angle, so as to support the skater in a balanced manner. When the skater performs a fancy skating, the elastic blocks 5 are compressed or twisted to bear the force from the foot, so that the skater can be maintained in balance. When the skater jumps, the elastic blocks 5 are vertically compressed to absorb the pressure (see FIG. 12), enabling the skater to keep the body in balance.

Further, because the wheels 7 are respectively mounted on the front wheel frame 2 and the rear wheel frame 3, the front wheel frame 2 and the rear wheel frame 3 are forced to deflect separately when the roller skate is tilted in one direction. Therefore, the front wheel frame 2 and the rear wheel frame 3 receive no torque when the skater changes the skating direction. This design greatly prolongs the service life of the in-line roller skate.

What is claim is:

1. An in-line roller skate comprising a boot, a front wheel frame having a through hole, a rear wheel frame having a through hole, two rivets, a brake block, and four wheels, said boot comprising two studs raised from a sole thereof near front and rear ends thereof and two through holes respectively defined in said studs through the sole, said rivets being respectively fastened to the through holes in the studs at said boot and the through holes at said front wheel frame and said rear wheel frame to secure said front wheel frame and said rear wheel frame to said boot, said front wheel frame and said rear wheel frame each having two transverse bolts arranged in parallel and a bottom screw hole at one end for holding said brake block, said wheels being respectively turned about the transverse bolts at said front wheel frame and said rear wheel frame and arranged in a line, said brake block being selectively fastened to the bottom screw hole at said front wheel frame or said rear wheel frame, wherein said boot comprises two bottom troughs transversely disposed at the sole and spaced between said studs, and a plurality of mounting holes respectively provided in said bottom troughs through the sole of said boot; said front wheel frame and said rear wheel frame each comprises a top trough, and a plurality of mounting holes in said top trough; two elastic blocks are respectively mounted in between the bottom troughs at the sole of said boot and the top troughs at said front wheel frame and said rear wheel frames, said elastic blocks each comprising a side open chamber, and a plurality of mounting holes through top and bottom side walls thereof in communication with said side open chamber, and two reinforcing rigid plates mounted in said side open chamber in each of said elastic blocks at top and bottom sides, each rein forming rigid plate having a plurality of screw holes respectively fastened to the mounting holes at said elastic block and the mounting holes in the bottom troughs at said boot and the mounting holes in the top troughs at said front wheel frame and said rear wheel frame by respective fastening elements.

2. The in-line roller skate of claim 1 wherein said elastic blocks are respectively molded from rubber.

3. The in-line roller skate of claim 1 wherein said fastening elements are screws.

4. The in-line roller rake of claim 1 wherein said fastening elements are rivets.

* * * * *